US005949308A

United States Patent [19]

Hino

[11] Patent Number: 5,949,308

[45] Date of Patent: Sep. 7, 1999

[54] DIELECTRIC FILTER AND METHOD OF REGULATING ITS FREQUENCY BANDWIDTH VIA AT LEAST ONE INSULATION GAP

[75] Inventor: Seigo Hino, Nagoya, Japan

[73] Assignee: NGK Spark Plug Co., Ltd., Nagoya, Japan

[21] Appl. No.: 08/595,067

[22] Filed: Feb. 1, 1996

[30] Foreign Application Priority Data

Feb. 2, 1995 [JP] Japan ..... 7-039005

[51] Int. Cl.[6] ..... H01P 1/201

[52] U.S. Cl. ..... 333/202; 333/206

[58] Field of Search ..... 333/203, 206, 333/207, 222, 223, 202, 202 DB FOR

[56] References Cited

U.S. PATENT DOCUMENTS

| | | | |
|---|---|---|---|
| 4,937,542 | 6/1990 | Nakatuko | 333/206 X |
| 5,146,193 | 9/1992 | Sokola | 333/206 |
| 5,721,520 | 2/1998 | McVeety et al. | 333/202 |

FOREIGN PATENT DOCUMENTS

| | | | |
|---|---|---|---|
| 5167309 | 7/1993 | Japan | 333/206 |
| 5259707 | 10/1993 | Japan | 333/202 DB |
| 6276005 | 9/1994 | Japan | 333/206 |

*Primary Examiner*—Benny Lee
*Attorney, Agent, or Firm*—Larson & Taylor

[57] ABSTRACT

There are provided a dielectric filter that shows a large effective bandwidth and a method of regulating the frequency bandwidth of a dielectric filter in order to achieve a large effective bandwidth, in which the dielectric filter comprises a dielectric ceramic block provided with three or more resonators arranged in parallel with each other and formed by respective resonant conductors, capacitive electrodes are provided at a position close to an electrically open-circuit end surface on one of four lateral surfaces of the dielectric ceramic block to respectively lie over the adjacently disposed resonant conductors, and a shield electrode provided on the lateral surface is partly removed at a position bordering the open-circuit end surface where the capacitive electrodes are located in order to form an insulation gap having a predetermined width.

6 Claims, 5 Drawing Sheets

DIELECTRIC FILTER AND METHOD OF REGULATING ITS FREQUENCY BANDWIDTH VIA AT LEAST ONE INSULATION GAP

BACKGROUND OF THE INVENTION

1. Technical Field

The present invention relates to a dielectric filter comprising a plurality of resonators and it also relates to a method of regulating the frequency bandwidth of such a dielectric filter.

2. Related Art

There have been proposed a variety of high frequency dielectric filters each comprising a dielectric ceramic block having a rectangularly parallelepipedic shape in which three or more through bores are formed in parallel with each other, the inner surface of each through bore is covered with an internal conductive layer or film operating as a resonant conductor, one of the oppositely disposed end surfaces of the dielectric ceramic block at which openings of the through bores are positioned is devoid of a shield electrode to form an electrically open-circuit end surface, the other end surface is provided with a shield electrode to form a short-circuit end surface along with the remaining four lateral side surfaces of the dielectric ceramic block. With a dielectric filter having such an arrangement, each of the resonant conductors operates as a resonator.

Referring to FIG. 1 of the accompanying drawings illustrating an equivalent circuit diagram of a dielectric filter of the type under consideration comprising three resonators Q1, Q2 and Q3, the filter can be polarized by coupling the resonators Q1 and Q2, and Q2 and Q3 respectively by coupling capacitances C1 and C2 to produce an attenuation pole on the lower frequency side of the center frequency. In FIG. 1, reference symbols L1 and L2 respectively denote inductances representing inductive couplings between the resonators Q1 and Q2, and Q2 and Q3, respectively.

In such a dielectric filter, chip capacitors are conventionally used for realizing or providing coupling capacitances C1 and C2 for the purpose of polarization and connected in series with the resonators.

However, such an arrangement requires a large number of components, which by turn make the assembling operation cumbersome and the assembled filter rather bulky.

In order to bypass this problem, as illustrated in FIG. 2 there has been proposed a dielectric filter comprising a rectangularly parallelepipedic dielectric ceramic block A in which three resonators made of resonant conductors B1, B2 and B3 that are arranged in parallel with each other along a given direction. Additionally, the first and second resonant conductors B1 and B2 are commonly flanked by a first capacitive electrode D1 at a position close to the electrically open-circuit end surface while the second and third resonant conductors B2 and B3 are similarly and commonly flanked by a second capacitive electrode D2 in such a way that the capacitive electrodes D1 and D2 are electrically insulated from shield electrodes E provided on the lateral side surfaces of the dielectric ceramic block A so that electrostatic capacitances are respectively produced by the capacitive electrodes.

Meanwhile, there has been an increasing demand for dielectric filters each having a large effective bandwidth, although those described above do not and cannot meet the demand unless a method of regulating the frequency bandwidth is provided which affords a desired wide bandwidth.

It is, therefore, one object of the present invention to provide a dielectric filter having a configuration as described above that shows a large effective bandwidth.

Another object of the present invention is to provide a method of regulating the frequency bandwidth of a dielectric filter in order to achieve such a large effective bandwidth.

SUMMARY OF THE INVENTION

According to one aspect of the invention, there is provided a dielectric filter comprising a dielectric ceramic block of a rectangularly parallelepipedic shape having a first and second end surfaces and four lateral side surfaces, the second end surface and the four lateral side surfaces being substantially provided with an electrically conductive layer which operates as a shield electrode, at least three resonators disposed in parallel with each other in said dielectric ceramic block, each resonator including a resonant conductor which comprises an electrically conductive layer provided on an inner surface of a through bore which extends between the first and second end surfaces of the dielectric ceramic block, each of the through bores having two openings, one through bore being positioned at the first end surface of the dielectric ceramic block which forms an electrically open-circuit end surface and the other through bore being positioned at the second end surface of the dielectric ceramic block which forms an electrically short-circuit end surface, capacitive electrodes being provided at a position close to the electrically open-circuit end surface on one of the four lateral side surfaces so that each capacitive electrode lies over a pair of two adjacently disposed resonant conductors, and at least one insulation gap having a predetermined width provided in the shield electrode portion on said one lateral side surface bordering the electrically open-circuit end surface and spreading between the adjacent capacitive electrode.

If, for example, the dielectric filter according to the present invention comprising a rectangularly parallelepipedic dielectric ceramic block is constructed as a triple-resonator type dielectric filter provided with three resonators, the insulation gap having a predetermined width may be formed at a position bordering the electrically open-circuit end surface between the first and second capacitive electrodes on the lateral side surface carrying the capacitive electrodes.

According to a second aspect of the present invention, there is provided a method of regulating the frequency bandwidth of a dielectric filter of the type under consideration wherein the method comprises the steps of partly removing the shield electrode portion on the lateral side surface bordering the electrically open-circuit end surface and spreading between the adjacent capacitive electrodes to form an insulation gap, and setting a width of the insulation gap so as to obtain a desired frequency bandwidth for the dielectric filter.

In the method of present invention, the setting of the width of said insulation gap may be performed based upon the basis of a relationship that the greater the insulation gap(s), the larger the frequency bandwidth of the dielectric filter.

In the present invention, by arranging such an insulation gap or insulation gaps on the basis of a relationship that the greater the insulation gap(s), the larger the frequency bandwidth of the dielectric filter, the attenuation pole that appears on the lower frequency side of the center frequency is shifted further toward the lower frequency side to flatten the frequency characteristic at and near the center frequency to consequently broaden the frequency bandwidth. Thus, a dielectric filter having one or more than one insulation gaps tends to show a frequency bandwidth greater than that of a dielectric filter without any insulation gap.

Additionally, a desired value can be selected for the frequency bandwidth by regulating the width of the insulation gap(s).

More specifically, in a high frequency dielectric filter of the type under consideration, the resonators comprising respective resonant conductors are mutually coupled by electric field coupling on the side of the electrically open-circuit end surface and by magnetic field coupling on the side of the short-circuit end surface. With the above described arrangement of the present invention, however, the electric field coupling of the dielectric filter is stronger than the magnetic field coupling because of the insulation gap(s) formed along the longitudinal direction of the resonant conductors at a position or positions bordering the electrically open-circuit end surface on a lateral side surface of the dielectric ceramic block where the capacitive electrodes are provided. The intensity of the magnetic field coupling is substantially equal to that of the electric field coupling on the lower frequency side of the center frequency to generate an attenuation pole on the lower frequency side. It will be appreciated that the electric field coupling is intensified as the width of the insulation gap(s) is increased to shift the attenuation pole further from the center frequency to the lower frequency side.

The insulation gap as described above may be produced by forming a longitudinal slit on the rectangularly parallelepipedic dielectric ceramic block by means of a dicing saw or by some other appropriate means to remove the shield electrode there.

Alternatively, it may be formed by removing the shield electrode to produce a strip-shaped area that is devoid of the shield electrode by means of a laser trimmer or a sand blast after coating the dielectric ceramic block with shield electrodes.

Still alternatively, the insulation gap may be formed simultaneously with the operation of coating the dielectric ceramic block with shield electrodes by creating a pattern using the technique of screen printing.

DETAILED DESCRIPTION OF THE PREFERRED EMBODIMENTS

Figure 1:
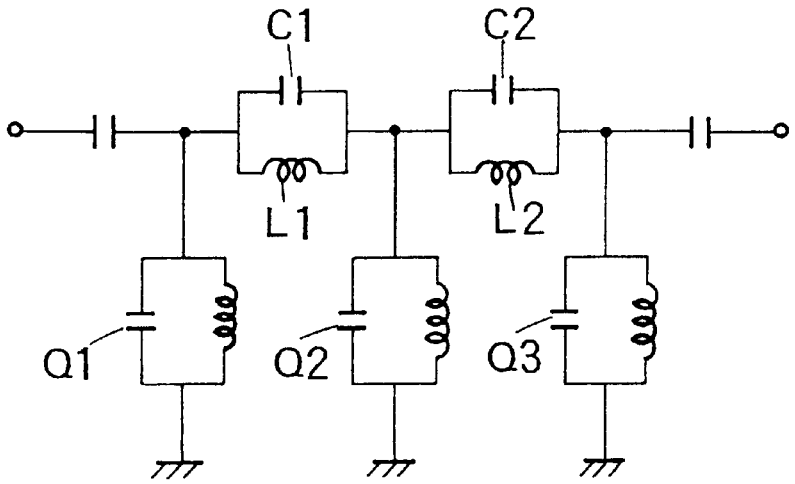
FIG. 1 PRIOR ART
FIG. 1 is an equivalent circuit diagram of a conventional dielectric filter to which the present invention may be applied.
Figure 3:
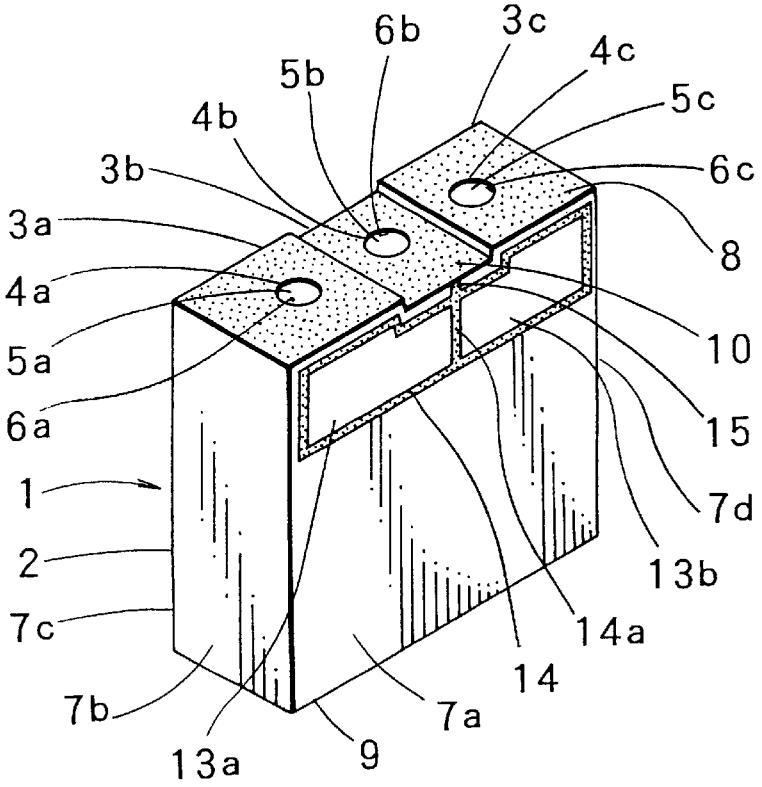
FIG. 3 is a schematic perspective view of a triple-resonator type high frequency dielectric filter according to the present invention.
Figure 4:
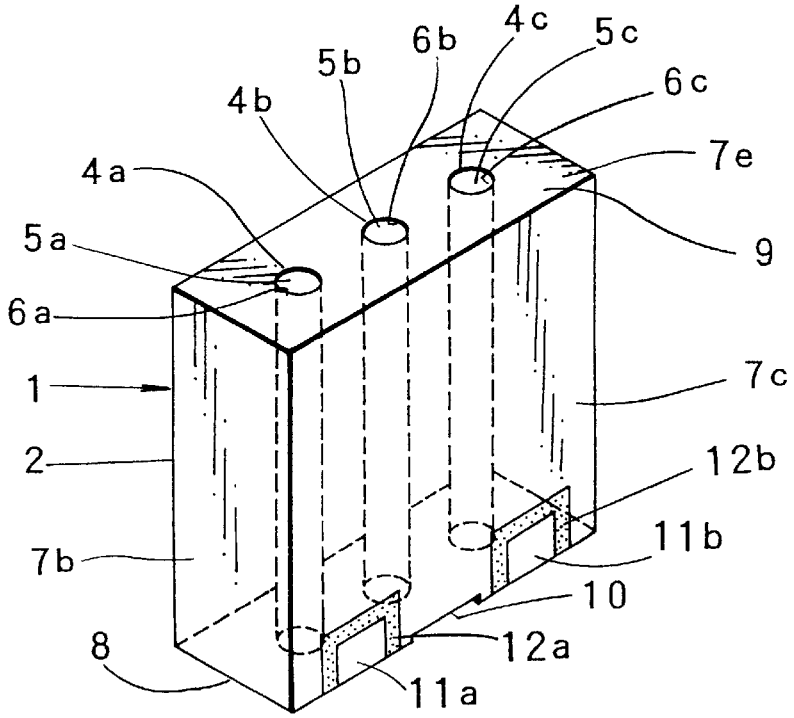
FIG. 4 is a schematic perspective view of the dielectric filter of FIG. 3 seen from behind.
Figure 5:
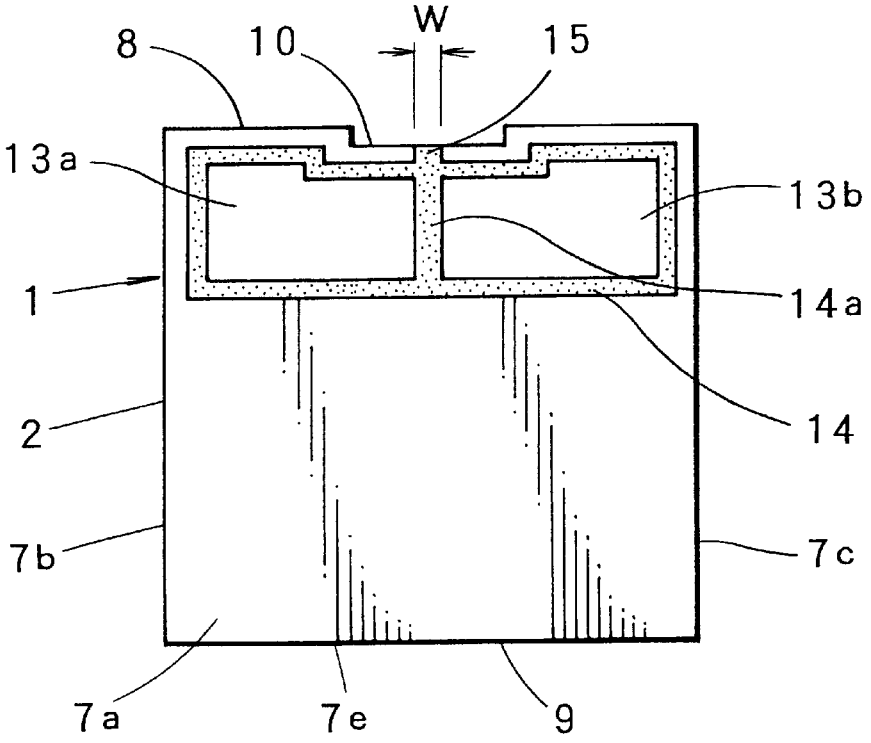
FIG. 5 is a plane view of the high frequency dielectric filter of FIG. 3.

FIGS. 3 through 5 illustrate a triple-resonator type frequency dielectric filter 1 comprising a single dielectric ceramic block 2 that is rectangularly parallelepipedic and provided with three resonators 3*a*, 3*b* and 3*c* (see FIG. 1) which are juxtaposed.

The dielectric ceramic block 2 is made of titanium oxide and has a rectangularly parallelepipedic profile. The three resonators 3*a*, 3*b* and 3*c* are respectively realized by arranging first, second and third resonant conductors 4*a*, 4*b* and 4*c* (see FIGS. 3, 4) in parallel with each other along a same direction. The resonant conductors 4*a*, 4*b* and 4*c* are formed by providing three through bores 5*a*, 5*b* and 5*c* (see FIGS. 3, 4) in the dielectric ceramic block 2 so that they extend from one end surface or a top end surface to the other end surface or a bottom end surface in parallel with each other and applying respective internal conductive layers or films 6*a*, 6*b* and 6*c* (see FIGS. 3, 4) on the inner surfaces of the respective through bores 5*a*, 5*b* and 5*c*. The four lateral side surfaces and the bottom end surface of the dielectric ceramic block 2 are coated with respective shield electrodes or grounding conductors 7*a* (see FIGS. 3, 5), 7*b*, 7*c*, 7*d* (see FIG. 3) and 7*e* (see FIGS. 4, 5), respectively. The top end surface of the dielectric ceramic block 2 having apertures or openings of the resonant conductors 4*a*, 4*b* and 4*c* is devoid of such a shield electrode to form an electrically open-circuit end surface 8, while the shield electrode 7*e* on the bottom end surface is electrically connected to the internal conductive films 6*a*, 6*b* and 6*c* of the resonators 3*a*, 3*b* and 3*c* and thus the bottom end surface forms a short-circuit end surface 9 as seen in FIG. 4. The dielectric ceramic block 2 has a recessed and stepped portion 10 on the electrically open-circuit end surface 8 where the resonator 3*b* is located in order to make the resonant conductor 4*b* slightly shorter than the remaining resonant conductors 4*a* and 4*c*.

On the other hand, as shown in FIG. 4, the dielectric ceramic block 2 carries on the rear lateral side surface a pair of input-output conductors 11*a* and 11*b* that are electrically insulated from the shield electrode 7*c* by gaps 12*a* and 12*b*. The input-output conductor 11*a* is capacitively connected to the internal conductive film 6*a* of the resonant conductor 4*a* by way of the dielectric ceramic block 2, whereas the input-output conductor 11*b* is capacitively connected to the internal conductive film 6*c* of the resonant conductor 4*c*. Either one of the input-output conductors 11*a* and 11*b* is electrically connected to the input terminal of a given electric path, whereas the other input-output conductor is electrically connected to the output terminal of the electric path to establish a closed circuit incorporating the high frequency dielectric filter 1.

Some of the principal sections of the dielectric filter of the present invention will now be described in greater detail.

On the lateral side surface or front side surface opposite to the lateral side surface of the dielectric ceramic block 2 carrying the input-output conductors 11*a* and 11*b* and at positions close to the electrically open-circuit end surface 8, there are provided, as shown in FIGS. 3, 5, a first capacitive electrode 13*a* lying, at least partly, over the first and second resonant conductors 4*a* and 4*b* and a second capacitive electrode 13*b* lying, at least partly, over the second and third resonant conductors 4*b* and 4*c*, the capacitive electrodes 13*a* and 13*b* being electrically isolated from the shield electrode 7*a* by means of a boundary gap 14 formed by removing the shield electrode 7*a* and surrounding the capacitive electrodes 13*a* and 13*b*. Note that the first and second capacitive electrodes 13*a* and 13*b* are separated from each other also by means of a portion 14*a* of the boundary gap 14.

Now, as shown in FIG. 5 and also shown in FIG. 3, an insulation gap 15 having a predetermined width W is formed as an extension of the boundary gap portion 14*a* extending toward the open-circuit end surface 8 also by removing the shield electrode 7*a*.

FIG. 6 shows graphs illustrating the frequency characteristics of dielectric filters having an insulation gap with different widths W from the view point of frequency (attenuation) as well as that of the conventional dielectric filter having no insulation gap. Note that the graphs are obtained by simulation. The graph (a) shows the relationship between frequency and attenuation of the conventional dielectric filter in which w=0, or no insulation gap is provided, the graphs (b), (c), and (d) show the relationship between frequency and attenuation of dielectric filters prepared in accordance with the present invention for three different widths W of the insulation gap 15. That is, the graphs (b), (c) and (d) respectively represent W=0.1 mm, W=0.5 mm and W=1.0 mm. In each case, an attenuation pole appears on the lower frequency side of the center frequency. In the case of the dielectric filter having no insulation gap as shown in FIG. 2 and the graph (a) of FIG. 6, the 3 dB bandwidth (the bandwidth with an attenuation of 3 dB from the level of the center frequency) is about 20 MHz, whereas the corresponding values for W=0.1 mm, W=0.5 mm and W=1.0 mm are about 40 MHz (the graph (b) of FIG. 6), about 52 MHz (the graph (c) of FIG. 6) and about 74 MHz (the graph (d) of FIG. 6), respectively.

Figure 7:
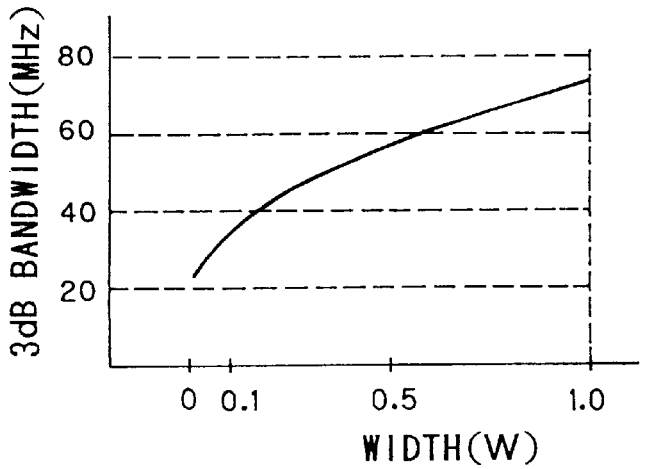
FIG. 7 is a graph showing a relationship between the 3 dB bandwidth and width W of the insulation gas.
Figure 6A:
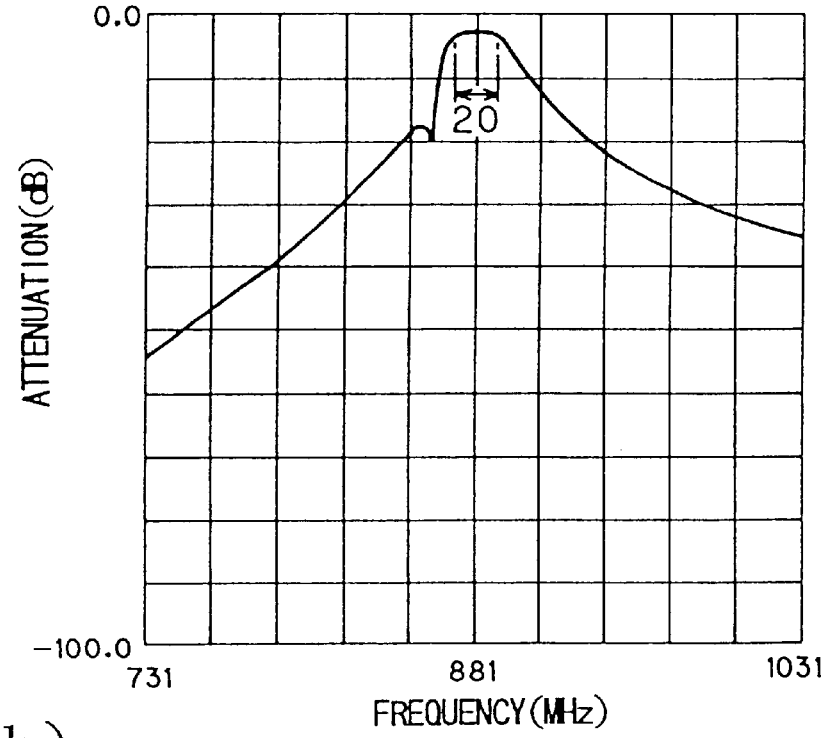
FIGS. 6(*a*), 6(*b*), 6(*c*), 6(*d*) show graphs illustrating the frequency characteristics of dielectric filters having an insulation gap with different widths prepared in accordance with present invention as compared with that of the conventional dielectric filter.
Figure 6B:
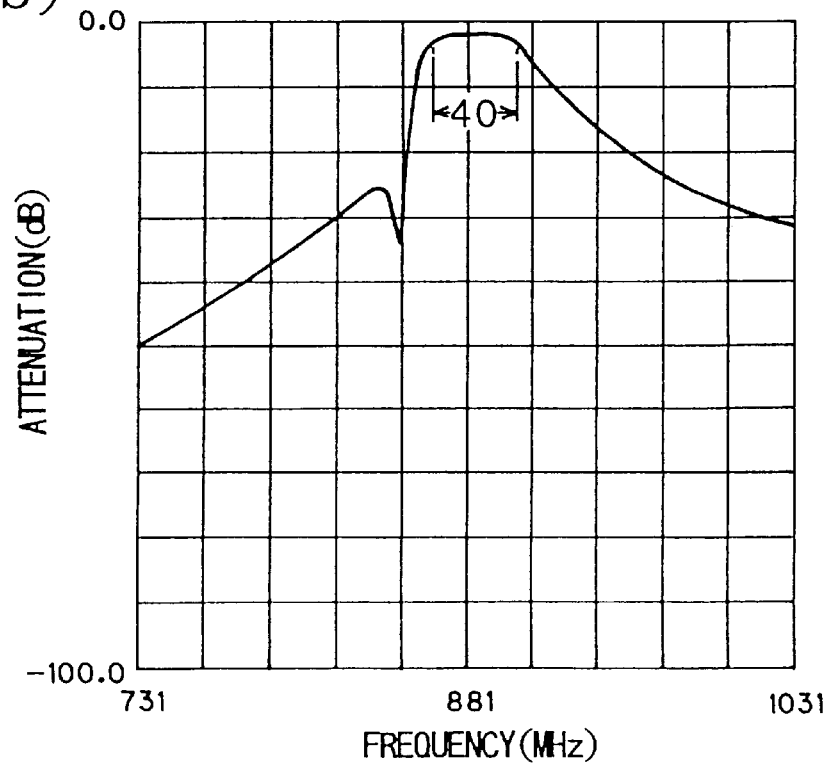
Figure 6C:
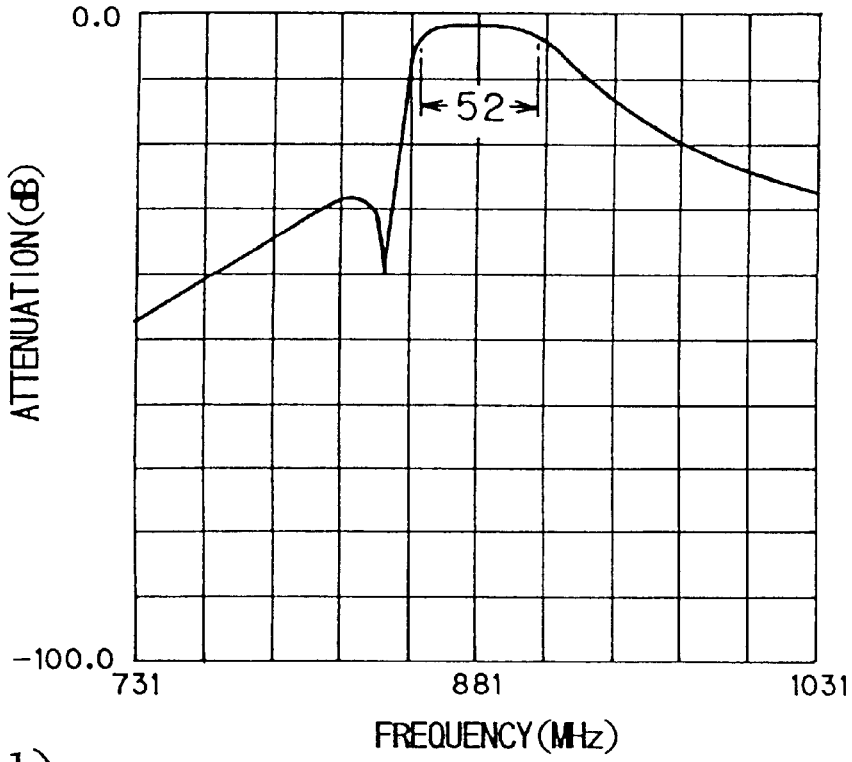
Figure 6D:
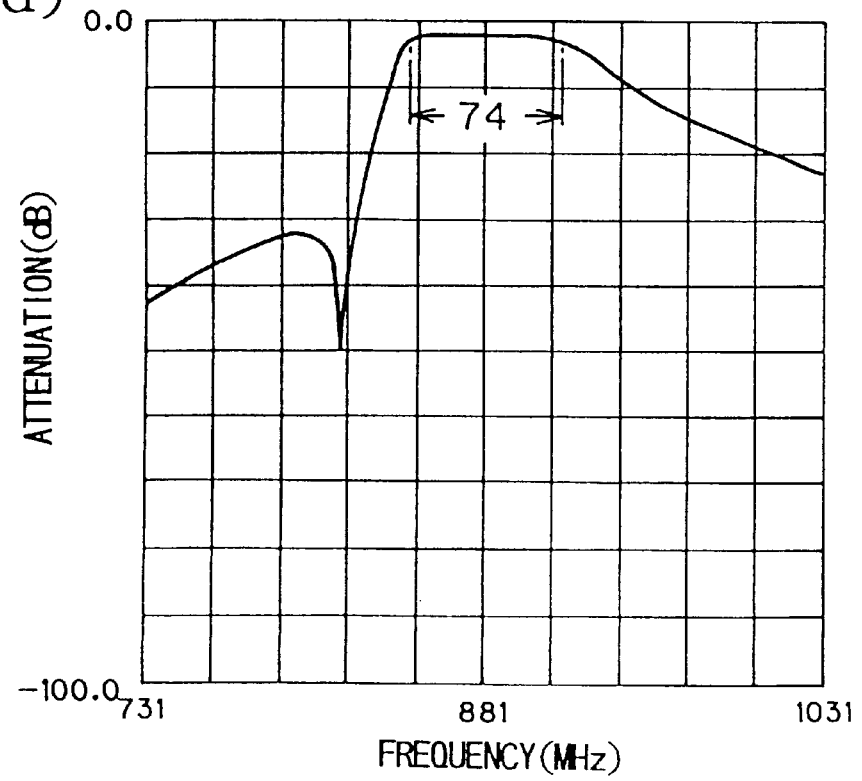

FIG. 7 is a graph showing a relationship between the 3 dB bandwidth and the width of the insulation gap 15. As illustrated, the 3 dB bandwidth increases, in the manner shown, with increasing width.

From these observations, it will be understood that the attenuation pole x is moved further away from the center frequency on the lower frequency side to produce a wide flattened area around the center frequency and a large effective bandwidth.

Figure 2:
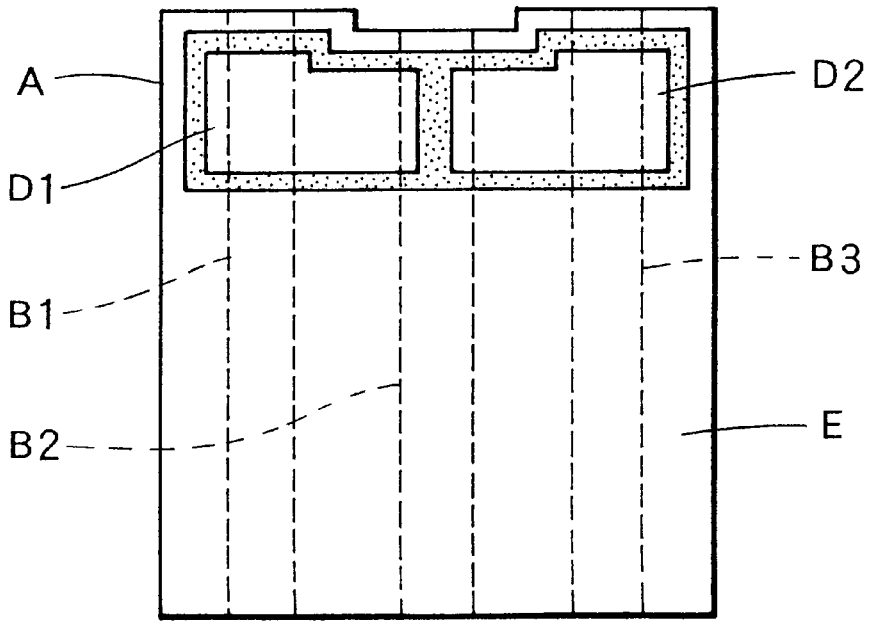
FIG. 2 PRIOR ART
FIG. 2 is a plane view showing an arrangement of a conventional high frequency dielectric filter.

In other words, a dielectric filter having an insulation gap shows a wider bandwidth than a dielectric filter having no such insulation gap as illustrated in FIG. 2. Therefore, the frequency bandwidth can be optimized by regulating the width of the insulation gap.

The insulation gap 15 may be accurately formed on a dielectric filter of the type under consideration by patterning, using a screen printing technique, in an operation of simultaneously producing the shield electrode. Alternatively, it may be produced by forming a shallow slit on the rectangularly parallelepipedic dielectric ceramic block by means of a dicing saw or by some other appropriate means and removing the shield electrode there. Alternatively, such a slit may be formed when the dielectric ceramic block is produced by press machining and applying a conductive material only on the related surface of the block not to cover the slit with the material so that the slit make an insulation gap. An insulation gap 15 may also be formed by partly removing the shield electrode formed on the related surface by means of a laser trimmer or a sand blaster.

Alternatively, it may be formed by removing the shield electrode to produce a strip-shaped area that is devoid of the shield electrode by means of a laser trimmer or a sand blaster after coating the dielectric ceramic block with shield electrodes.

Still alternatively, the insulation gap 15 may be formed simultaneously with the operation of coating the dielectric ceramic block with shield electrodes by producing a pattern using the technique of screen printing.

Again, the frequency bandwidth or the attenuation pole generating frequency of a dielectric filter 1 having a configuration as described above can be regulated by controlling the width W of the insulation gap 15. Therefore, whenever necessary, the characteristic of the dielectric filter can be easily regulated by modifying the width W of the insulation gap 15 by, for example, partly scraping off the shield electrode 7*a* around the insulation gap 15 or, conversely, partly covering the insulation gap 15 with conductive film to reduce the width of the insulation gap 15.

While all of the above described high frequency dielectric filters comprise three resonators 3*a*, 3*b* and 3*c*, it will be understood that the present invention is equally applicable to high frequency dielectric filters having two, four or more than four resonators.

According to the invention, in a dielectric filter of the type under consideration, capacitive electrodes are additionally provided at a position close to the electrically open-circuit end surface on one of the four lateral surfaces, each of said capacitive electrodes lying over a pair of two adjacently disposed resonant conductors, such that the shield electrode on said lateral side surface is partly removed at one or more than one positions bordering the electrically open-circuit end surface where said capacitive electrodes are located in order to form one or more than one insulation gaps having a predetermined width there. By arranging the insulation gap or insulation gaps, the attenuation pole that appears on the lower frequency side of the center frequency is shifted further on the lower frequency side to flatten the frequency characteristic at and near the center frequency to consequently broaden the frequency bandwidth. Thus, a dielectric filter having one or more than one insulation gaps tends to show a frequency bandwidth greater than that of a dielectric filter without any insulation gap Additionally, the frequency bandwidth of a dielectric filter of the type under consideration can be easily regulated on the basis of a relationship that the greater the insulation gap(s), the larger the frequency bandwidth of the dielectric filter.

I claim:

1. A dielectric filter comprising a dielectric ceramic block of a rectangular parallelepipedic shape having a first and second end surfaces and four lateral side surfaces, the second end surface and the four lateral side surfaces being substantially provided with an electrically conductive layer which functions as a shield electrode;

at least three resonators disposed in parallel with each other in said dielectric ceramic block, each resonator including a respective resonant conductor which comprises an electrically conductive layer provided on an inner surface of a corresponding through bore which respectively extends between the first and second end surfaces of said dielectric ceramic block, each of said through bores respectively having two opposed openings, each through bore having one opening thereof positioned at the first end surface of said dielectric ceramic block thereby defining an electrically open-circuit end surface and each through bore having the opposing opening thereof positioned at the second end surface of the dielectric ceramic block thereby defining an electrically short-circuit end surface;

capacitive electrodes provided at a position close to the electrically open-circuit end surface on one of said four lateral side surfaces, each of said capacitive electrodes respectively flanking a pair of two adjacently disposed resonant conductors so as to lie directly alongside of the respective pair of two adjacently disposed resonant conductors; and at least one insulation gap having a predetermined width provided in the shield electrode portion on said one lateral side surface, said at least one insulation gap directly bordering the electrically open-circuit end surface and extending between the adjacent capacitive electrodes, and said at least one insulation gap electrically isolating the adjacent capacitive electrodes from the shield electrode portion.

2. A dielectric filter as claimed in claim 1, wherein said each insulation gap comprises a respective gap in the shield electrode on the one lateral side surface where said capacitive electrodes are located.

3. A dielectric filter as claimed in claim 1, wherein said each insulation gap is an extension of a respective boundary gap surrounding said capacitive electrodes, and extends from said respective boundary gap to the open-circuit end surface of said dielectric ceramic block.

4. A dielectric filter as claimed in claim 1, wherein the number of said resonant conductors is three, and wherein said capacitive electrodes comprise a first capacitive electrode located at a position close to the electrically open-circuit end surface on one of said four lateral side surfaces to lie over said first and second resonant conductors, and a second capacitive electrode located at a position close to the electrically open end surface on said lateral side surface to lie over the second and third resonant conductors, said at least one insulation gap comprising an insulation gap extending from a portion of a boundary gap located between said first and second capacitive electrodes to said electrically open-circuit end surface.

5. A method of regulating the frequency bandwidth of a dielectric filter comprising a dielectric ceramic block of a rectangular parallelepipedic shape having a first and second end surface and four lateral side surfaces, the second end surface and the four lateral side surfaces being substantially provided with an electrically conductive layer which functions as a shield electrode, in which at least three resonators disposed in parallel with each other in said dielectric ceramic block, each resonator includes a respective resonant conductor which comprises an electrically conductive layer provided on an inner surface of a corresponding through bore which respectively extends between the first and second end surfaces of said dielectric ceramic block, each of said through bores respectively having two opposed openings, each through bore having one opening thereof positioned at the first end surface of said dielectric ceramic block thereby defining an electrically open-circuit end surface and each through bore having the opposing opening thereof positioned at the second end surface of the dielectric ceramic block thereby defining an electrically short-circuit end surface, and capacitive electrodes are provided at a position close to the electrically open-circuit end surface on one of said four lateral side surfaces so that each capacitive electrode respectively lies directly over a pair of two adjacently disposed resonant conductors, wherein the method comprises the steps of partly removing the shield electrode portion on said one lateral side surface directly bordering the electrically open-circuit end surface and extending between the adjacent capacitive electrodes to form a respective insulation gap, and setting a width of said respective insulation gap so as to obtain a desired frequency bandwidth for the dielectric filter.

6. A method as claimed in claim 5, wherein the setting of the respective width of the corresponding insulation gap is performed based upon a relationship that the greater the insulation gap, the larger the frequency bandwidth of the dielectric filter.

* * * * *